US007051620B2

(12) United States Patent
Jarvis

(10) Patent No.: US 7,051,620 B2
(45) Date of Patent: May 30, 2006

(54) SPECIAL OPENING TOOL AND METHOD

(76) Inventor: Harold Jarvis, 1441 N. Leland St., Indianapolis, IN (US) 46219

( * ) Notice: Subject to any disclaimer, the term of this patent is extended or adjusted under 35 U.S.C. 154(b) by 0 days.

(21) Appl. No.: 11/148,025

(22) Filed: Jun. 9, 2005

(65) Prior Publication Data

US 2006/0042421 A1 Mar. 2, 2006

Related U.S. Application Data

(62) Division of application No. 10/928,885, filed on Aug. 30, 2004, now Pat. No. 6,971,281.

(51) Int. Cl.
*B67B 7/00* (2006.01)

(52) U.S. Cl. ..... 81/3.08; 81/3.55

(58) Field of Classification Search ..... 29/426.4; 81/3.08, 3.55

See application file for complete search history.

(56) References Cited

U.S. PATENT DOCUMENTS 4,207,781 A * 6/1980 Greenwood ..... 81/3.55
4,241,626 A * 12/1980 Hall ..... 81/3.55
4,362,071 A * 12/1982 Coker ..... 81/3.55
4,373,246 A * 2/1983 VanHoutte et al. ..... 29/426.4
4,416,171 A * 11/1983 Chmela et al. ..... 81/3.55
4,466,313 A * 8/1984 Gardner ..... 81/3.55
5,018,409 A * 5/1991 Bittel ..... 81/3.55
5,277,083 A * 1/1994 Madonia ..... 81/3.09
5,390,567 A * 2/1995 Martorell ..... 81/3.09
5,555,778 A * 9/1996 Otters et al. ..... 81/3.55
6,070,497 A * 6/2000 Farelli ..... 81/3.09
6,709,125 B1 * 3/2004 Jarvis ..... 362/84
6,945,137 B1 * 9/2005 Hawkins ..... 81/3.55

* cited by examiner

*Primary Examiner*—David B. Thomas
(74) *Attorney, Agent, or Firm*—Daniel J. O'Connor

(57) ABSTRACT

A specialized tool for opening a particular type of container and lid configuration which is used in the food and beverage arts. The tool includes a handle section and an operating section. The operating section includes a jaw portion with a pointed lower lip and an open area. The operating section further includes a curved lower lid contacting area and at least one notch for contacting a rim on a container and providing a pivot point. The tool is useful for any person who may have difficulty in opening the particular container type described. A method of use and a specially designed support base are also described.

1 Claim, 4 Drawing Sheets

SPECIAL OPENING TOOL AND METHOD

This is a division of Ser. No. 10/928,885, filed Aug. 30, 2004 now U.S. Pat. No. 6,971,281.

BACKGROUND AND OBJECTS OF THE INVENTION

The present invention is generally related to the tool arts and, in particular, to a specially designed tool for opening a certain type of lid.

Certain types of cans and lids are currently being sold wherein the lid has a pull tab permantly attached to the top thereof. When the pull tab is manually lifted, the entire lid may be removed from the top of a can. While sometimes a convenient feature, the above system does have some problems in the art.

For example, younger people and handicapped persons may find the manual tab pulling operation difficult or impossible to perform. Persons with long finger nails may also find the tab pulling and lifting to be a rather difficult task.

It has been further found in the art that the location of sharp lid edges near the fingers of the user may pose a potentially serious safety problem for the user.

Accordingly, it is an object of the invention to set forth a specisl tool for opening of the pull tab lid.

It is a further object of the invention to demonstrate a novel tool which eliminates the awkwardness and possible danger in manually opening the pull tab lid.

It is a still further object to show a special tool which may be economically manufactured for widespread commercial appeal.

A specially designed supporting stand for use with the tool is also described.

These and other objects and advantages of the present invention will be apparent to those of skill in the art from the description which follows.

PRIOR ART PATENTS AND DESIGNS

During the course of preparing this specification for submission to the U.S. Patent Office, a full search of the prior art was conducted.

Patents which are believed to be generally related to the present invention are as follows:

U.S. Pat. No. 4,416,171 issued to Chmela et al. for a tab-top can opener,

U.S. Pat. No. 6,709,125 issued to Harold Jarvis for an easy opening device for beverage cans, U.S. Pat. Nos. 5,277,083 and 4,466,313 for can opening systems and methods.

The present invention is believed to clearly define over the prior art systems and methods in the container opening arts.

SUMMARY OF THE INVENTION

The invention is utilized in combination with containers having a pull tab to pull off the entire cover or lid.

The tool is a one-piece flat, transparent plastic unit with a tubular handle placed thereon.

A left hand or operating portion of the tool includes a curved lid contacting portion which extends to a handle at a particular angle. The curved lid contacting portion also extends to a jaw section.

The jaw section includes an upper lip and an open area. The jaw section further includes a lower extended lip means for sliding under a pull tab element.

Support means for the tool are disclosed which allow the unusually shaped tool unit to be displayed in a vertically standing position. The support means may also be made of transparent plastic material.

BRIEF DESCRIPTION OF THE DRAWING FIGURES

FULL DESCRIPTION OF THE PREFERRED EMBODIMENTS

Figure 1:
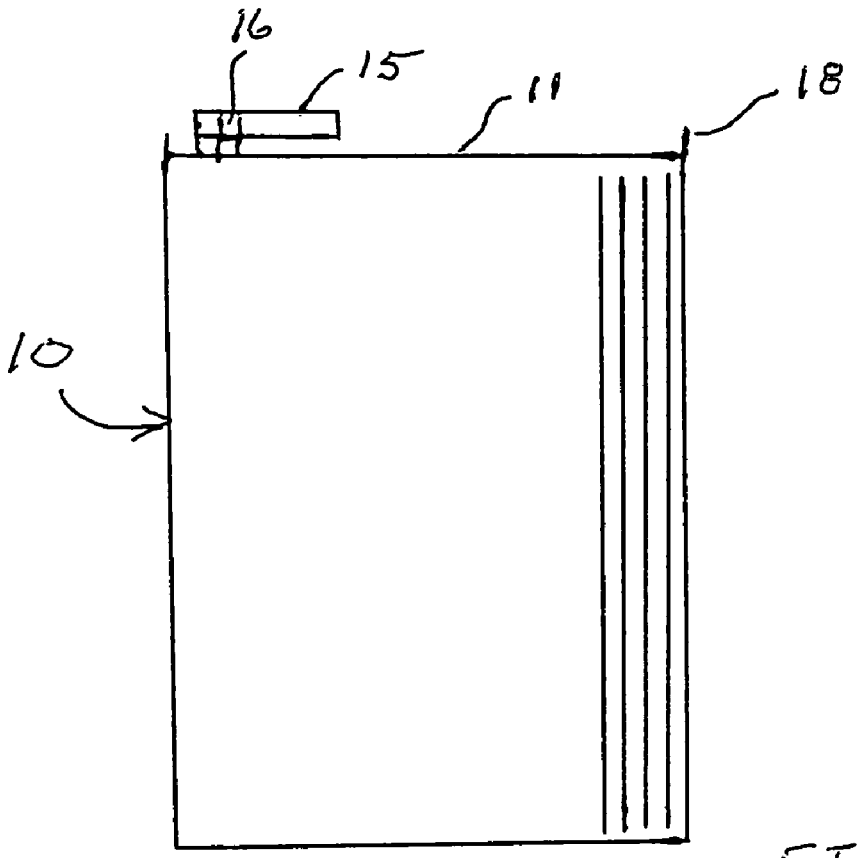
FIG. 1 shows a side view of the type of container and pull tab unit for which the invention tool is designed.
Figure 2:
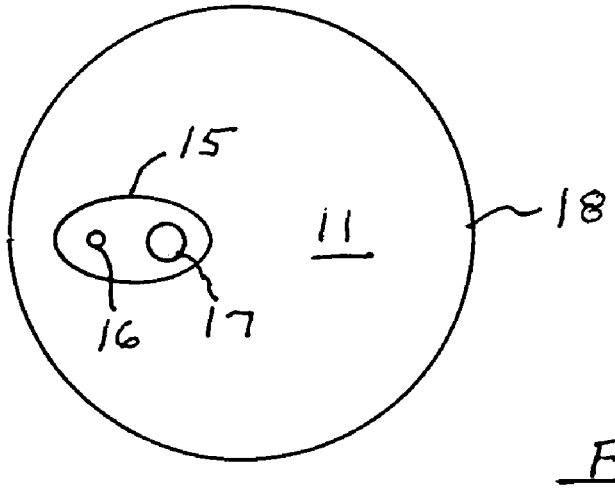
FIG. 2 is a top view of the pull tab and lid for which the tool is used in combination.

Referring to the drawing FIGS. 1 and 2, a container 10 is shown as having a sealed lid 11. The lid includes a pull tab element 15 which is fixedly attached to the lid via attaching means 16. Numeral 18 shows the container rim or ridge.

Pull tab element 15 further includes an aperture 17 which is typically used to grasp and pull the lid and tab combination off of the container.

The type of unit shown in FIGS. 1 and 2 is difficult and possibly dangerous to operate for younger persons, handicapped persons and persons with long finger nails.

Figure 3:
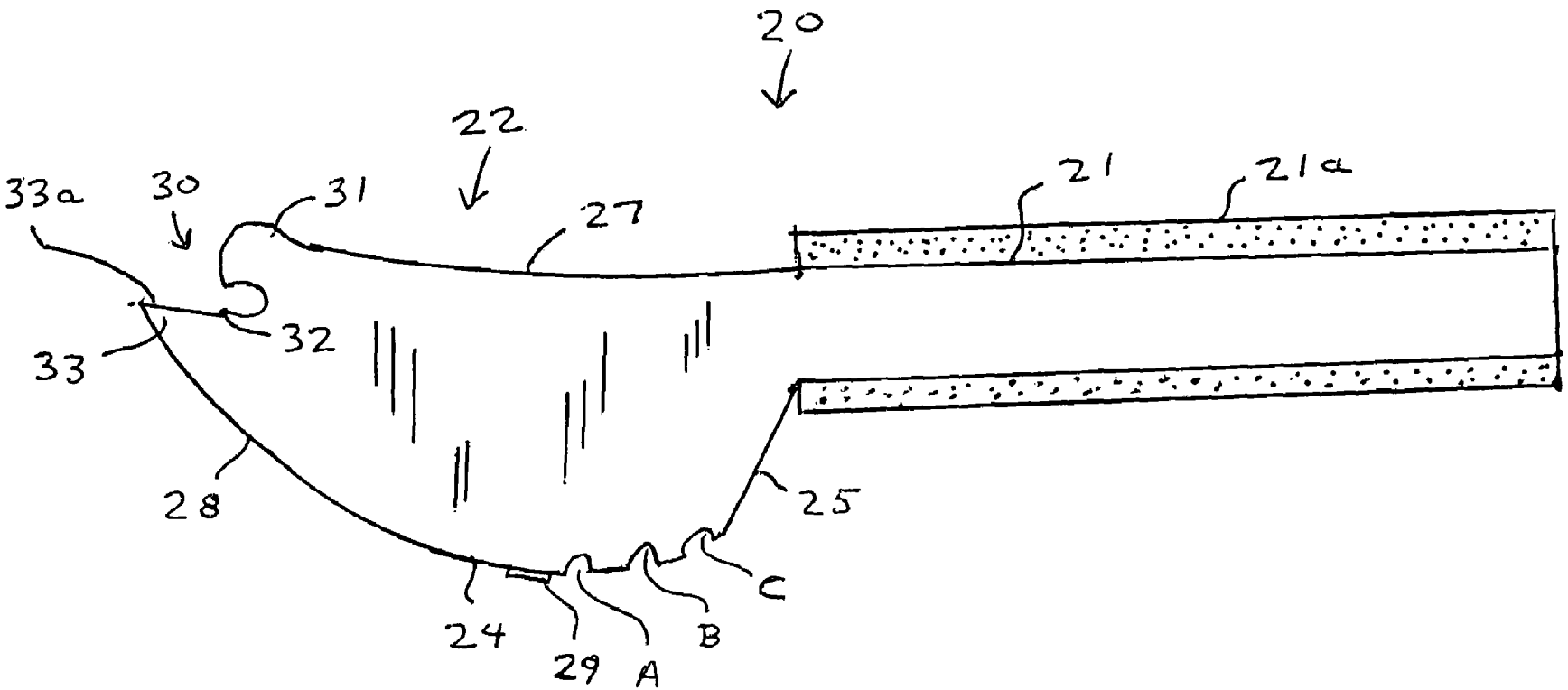
FIG. 3 is a side schematic view of the tool showing the various important portions and sections.

Referring to the tool of FIG. 3, the overall tool 20 has a right hand grasping portion 21 and a left hand operating portion 22. Operating portion 22 includes a jaw section or portion 30 to be further described. A cover 21*a* for the grasping portion 21 is also indicated in FIG. 3.

Referring further to FIG. 3, the operating portion 22 includes an upper edge 27 which extends to the grasping or handle portion 21.

Operating portion 22 has a curved lid contacting section 24. As indicated at numeral 25, section 24 extends to the handle portion 21 at an angle of approximately sixty degrees from the horizontal.

As indicated at numeral 28, section 24 extends to a jaw section or portion 30 at an angle of approximately thirty-five degrees from the horizontal of FIG. 3.

The jaw portion 30 includes an upper lip 31 and an open area 32 which is essentially circular in shape.

Jaw portion 30 further includes a lower lip 33. As indicated a numeral 33*a*, the lower lip extends about 0.2 inches beyond the upper lip 31. Such sizing and angled features help in grasping a pull tab unit as will be further described.

The method steps for using the described tool in combination with a container having a pull tab lid structure include the following:

1) position the tool open area 32 onto the tab aperture element 17,
2) push the tab forward to break the container seal,
3) push down on the tool handle to lift lid 11,
4) gently twist handle to break the final portion of the lid seal.

Some important aspects of the structure of the invention are as follows:

transparent tool operating section to permit viewing of the seal breaking operation at all angles even if the person is at a lower angle, one-piece plastic molded construction of handle 21 and operating portion 22 to provide for strength and economy of manufacture, extended lower lip 33*a* to provide for easy grasping of pull tab aperture 17.

Other important aspects of the invention include the provision of notch elements A, B and C at the lower back end of the operating section.

The notches are designed and shaped so as to contact and rest on rim 18 during the opening of the container.

Thus, for a smaller size container, notch A would contact rim 18 to provide a pivot point and render the lifting operation more efficient. Notches B and C are provided for progressively larger containers.

FIG. 3 also shows the provision of a magnet 29 for the purpose of picking up the lid once the opening operation is completed. Magnet 29 thus provides a safety feature so that the user need not contact the sharp and possibly dangerous removed lid.

The tool support aspects of the invention are described with reference to FIGS. 4 and 5.

Figure 4:
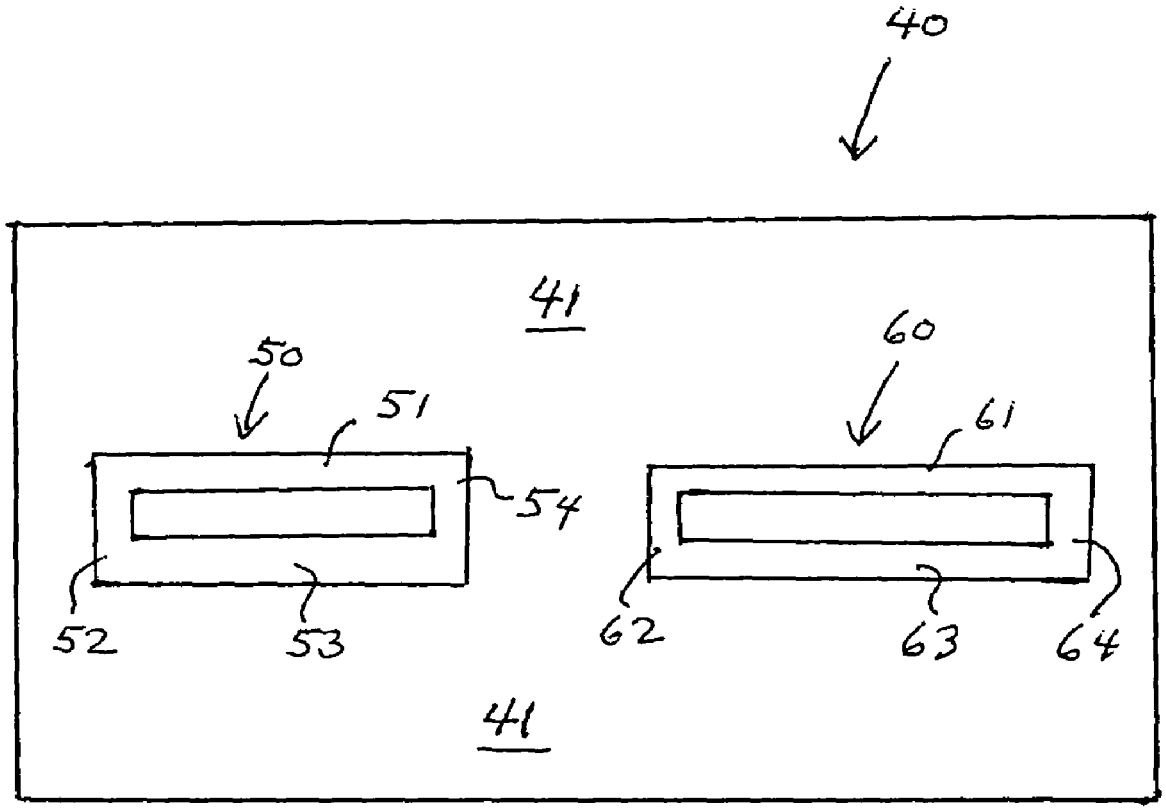
FIG. 4 is a top schematic view of a support for the tool and tool jaw portion. The support includes dual support means for multiple types of tools.
Figure 5:
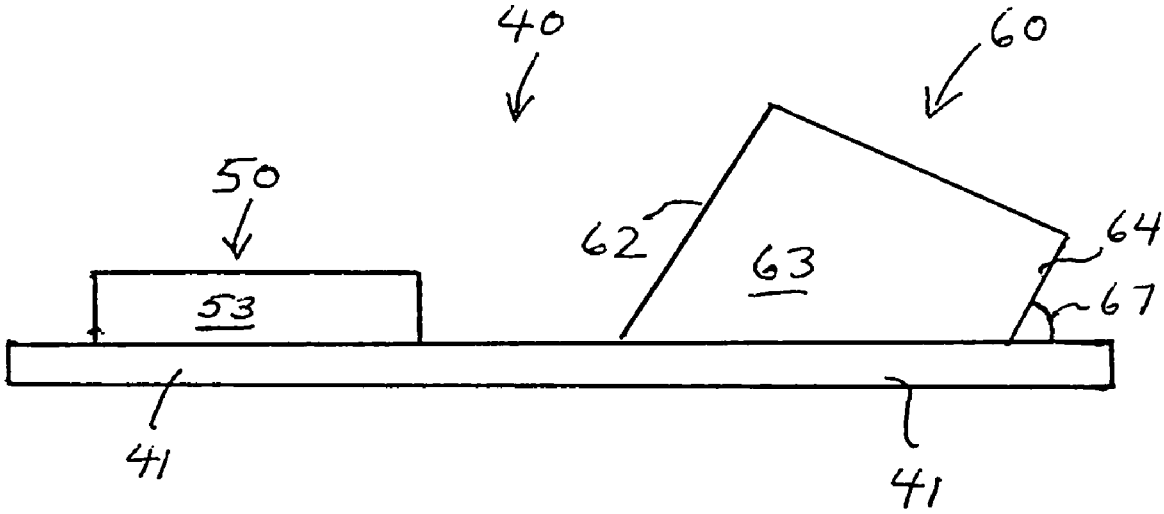
FIG. 5 is a side schematic view of the support member of FIG. 4 and shows an angled support configuration so as to maintain the tool in a vertical stored position.

The aspects of the invention constituting the support means are shown in FIGS. 4 and 5.

In the top view of FIG. 4, a plastic dual support element 40 is shown as having a base 41 and two support elements 50 and 60. Support 50 comprises walls 51–54 and is sized so as to receive the end of an opener of a type described by Jarvis in U.S. Pat. No. 6,709,125.

Support element 60 also comprises four walls 61–64. The walls 62 and 64 are angled at about seventy degrees from the horizontal in order to provide support for the curved tool of FIG. 3.

The sharp point of the tool 20, i.e. the jaw section 30 fits into the support 60 so that part 28 of the tool rests upon angled wall 64. The angle of wall 64 is indicated by numeral 67. In this manner, the tool handle 21 extends vertically, i.e. at ninety degrees, from the base 41 for the purposes of display and protection of the tool.

While particular structures and methods of use have been described herein, it is intended in this specification to cover all equivalent systems and methods which would reasonably occur to those of skill in the art.

The invention is further defined by the claim recitals appended heteto.

I claim:

1. A method of opening a container (10) of a type having an upper rim (18), a lid (11) covering the entire top of said container, a tab (15) permanently attached to said lid and an aperture (17) formed in said tab, said method including the use of a tool (20) and a support means (40) for holding said tool (20), said tool having a handle (21) and an operating portion (22) which includes a jaw section (30) having a lower extended lip (33*a*) and an open area (32), said tool operating portion further including at least one notch (A) on a lower end (24) thereof, said support means comprising a base (41) being about five inches in length and including a left hand support (50) having four walls (51–54) which extend perpendicular to said base (41) and provide means for receiving an opener having a straight end, said left hand support being one inch in length, said support means further including a right hand support (60) which comprises four walls (61–64) and wherein two of said walls (62,64) are angled at about seventy degrees from a horizontal plane to provide support means for the jaw section (30) of the tool used in the opening method when in storage, said right hand support (60) providing means such that the tool handle (21) extends vertically from the base (41) for the purposes of displaying and protecting the tool, the method comprising the following steps:

a) removing the tool (20) from the support means (40), b) positioning the tool open area (32) into the tab aperture (17), c) pushing the tab forward using the tool to break a seal on the container, d) positioning the notch (A) over the rim (18) to provide a pivot point, e) pushing down on the tool handle to lift the lid off of the container.

* * * * *